US007438278B2

(12) United States Patent
Wagner

(10) Patent No.: US 7,438,278 B2
(45) Date of Patent: Oct. 21, 2008

(54) TOOL FOR EXTRACTING AN EMBEDDED ELONGATED OBJECT

(76) Inventor: Jefferson L. Wagner, 354 Lynwood Dr., Charleston, SC (US) 29414

( * ) Notice: Subject to any disclaimer, the term of this patent is extended or adjusted under 35 U.S.C. 154(b) by 363 days.

(21) Appl. No.: 11/237,401

(22) Filed: Sep. 28, 2005

(65) Prior Publication Data

US 2006/0022178 A1 Feb. 2, 2006

Related U.S. Application Data

(63) Continuation-in-part of application No. 10/811,625, filed on Mar. 29, 2004, now Pat. No. 7,118,093.

(51) Int. Cl.
*B25C 11/00* (2006.01)
*B66F 15/00* (2006.01)

(52) U.S. Cl. ..... 254/22; 254/23; 254/24; 254/32; 254/384; 29/268; 81/381; 81/383; 81/15.8

(58) Field of Classification Search ..... 254/22, 254/23, 32, 24, 384; 29/268; 81/381, 383, 81/15.8

See application file for complete search history.

(56) References Cited

U.S. PATENT DOCUMENTS

| | | | | |
|---|---|---|---|---|
| 82,568 | A | 9/1868 | Tyzick et al. | |
| 222,295 | A | 10/1879 | McKeever | |
| 724,523 | A | 4/1903 | Threlkeld et al. | |
| 725,902 | A | 4/1903 | Welsh | |
| 832,387 | A | 10/1906 | Jensen | |
| 943,322 | A | 12/1909 | Soles | |
| 990,926 | A | 5/1911 | Swainson | |
| 1,151,772 | A * | 8/1915 | Erickson | 81/383 |
| 1,710,929 | A * | 4/1929 | Kelleway | 81/381 |
| 2,336,961 | A | 12/1943 | Russell | |
| 2,501,500 | A | 3/1950 | De Armond | |
| 2,578,230 | A | 12/1951 | Davis | |
| 2,870,988 | A | 1/1959 | Vazquez | |
| 4,007,913 | A | 2/1977 | Aldrich | |
| 4,084,457 | A | 4/1978 | Berg | |
| 4,097,021 | A | 6/1978 | Loboda | |

(Continued)

FOREIGN PATENT DOCUMENTS

| | | |
|---|---|---|
| DE | 91 08 207 U1 | 8/1991 |

(Continued)

*Primary Examiner*—Joseph J. Hail, III
*Assistant Examiner*—Shantese L McDonald
(74) *Attorney, Agent, or Firm*—Harleston Law Firm, LLC

(57) ABSTRACT

A hand operated tool for extracting an embedded elongated object, includes: a) an elongated, movable first handle member with a first, upper end portion divided into two matching legs separated by an opening; b) a corresponding second handle member with a first jaw member and a first, upper end extending through the leg opening, the second handle member being pivotally attached to both legs; c) a floating head portion pivotally attached to the first and second legs, the floating head portion including a second jaw member and an adjacent, upper curved edge; and d) two matching lever bars facing one another from opposite sides of the tool, each being pivotally connected to the second handle member and to the floating head portion; and wherein the second jaw member is engaged against the first jaw member in a closed tool position, and disengaged from the first jaw member in an open tool position.

20 Claims, 7 Drawing Sheets

U.S. PATENT DOCUMENTS

| | | | | |
|---|---|---|---|---|
| 4,643,054 | A | | 2/1987 | Nelson |
| 4,776,568 | A | | 10/1988 | Perel |
| 4,798,366 | A | | 1/1989 | Pearson et al. |
| 4,815,707 | A | | 3/1989 | Brown |
| 4,856,759 | A | | 8/1989 | Ness |
| 4,953,248 | A | | 9/1990 | Trombetta |
| 4,997,163 | A | | 3/1991 | Henning |
| 5,033,140 | A | * | 7/1991 | Chen et al. ..... 7/127 |
| 5,150,488 | A | | 9/1992 | Yuan et al. |
| 5,575,029 | A | | 11/1996 | Simpson |
| 5,636,398 | A | | 6/1997 | Fike |
| 5,749,113 | A | | 5/1998 | Witter |
| 5,799,381 | A | | 9/1998 | Gannon et al. |
| 6,105,935 | A | | 8/2000 | Wagner |
| 6,202,517 | B1 | | 3/2001 | Dolan |
| 6,223,373 | B1 | | 5/2001 | Yeh |
| 6,314,599 | B1 | | 11/2001 | Hay |
| 6,701,560 | B2 | | 3/2004 | Foley |
| 6,733,001 | B2 | | 5/2004 | Wagner |
| 2002/0056832 | A1 | | 5/2002 | Wagner |
| 2003/0192129 | A1 | | 10/2003 | Foley |

FOREIGN PATENT DOCUMENTS

| | | | |
|---|---|---|---|
| DE | 295 03 960 | U1 | 4/1995 |
| WO | WO 2005/097426 | A1 | 10/2005 |

* cited by examiner

TOOL FOR EXTRACTING AN EMBEDDED ELONGATED OBJECT

CROSS REFERENCE TO RELATED DOCUMENT

This invention is a continuation-in-part of U.S. patent application Ser. No. 10/811,625, filed in the U.S. Patent & Trademark Office on Mar. 29, 2004 now U.S. Pat. No. 7,118,093, as amended.

BACKGROUND OF THE INVENTION

1. Technical Field

The present invention relates generally to a hand-operated tool, and more particularly to a tool for extracting an elongated object, especially a staple, nail or tack, that is embedded in the surface of a body, such as a wooden board.

2. Background Information

In construction, more labor means higher cost. A small amount of time saved in pulling each spent staple, nail or tack from various surfaces in a building during a remodeling project can mean significant labor savings when the time savings for all of the craftsmen for the duration of the remodeling project are tallied. In short, a better extraction tool allows talented craftsmen to spend their time on more challenging tasks.

Generally, various tools for helping carpenters and other workers remove spent nails or the like from surfaces are known. Unfortunately, nail heads are often partially or wholly broken off when a molding or other surface is removed during remodeling. There are also many new types of nails and staples being manufactured today. Many of these new types of nails have smooth finishes and are more slender than nails used in previous generations. Pneumatic finishing nails, for example, ordinarily have a very small, thin head. Wiring staples are also bothersome to remove. They are installed, often every 16 inches, over electrical wires to hold the wires in place on wall studs. Modern nails and staples also vary widely in length and diameter. They can be difficult to remove without bending or snapping them, or splintering or otherwise damaging the wooden and other surfaces in which they are embedded.

Practically speaking, nails, tacks, and staples do not often present themselves in an erect fashion for removal from boards and other surfaces. A significant percentage of nails, tacks, and staples to be removed are smashed against the surface, or otherwise bent and/or broken off.

Unfortunately, it is difficult to consistently pull a variety of nail types, as well as tacks and staples, under varying conditions using currently available tools. Some workers attempt to use conventional pliers or channel locks to pull nails through wooden boards, which often causes portions of the nail to break or shear off. Available tools often work only on nails which present a substantially straight and significant shaft segment for a nail puller tool to grasp. When a carpenter has to straighten nails in order to use a nail pulling tool, time is wasted. When he or she has to carry several tools for nail, tack and staple removal, and pause to select which tool to use to remove each nail, time is wasted. This is particularly inconvenient when the worker is in an awkward position on a ladder or on a roof or in a crawl space, for example. Incorrect staple, nail or tack removal can result in damage to the wooden surface, such as gouges or holes. In addition, worker frustration and the high physical demands of construction-related jobs are decreased somewhat when nails and the like can be more easily removed.

BRIEF SUMMARY OF THE INVENTION

The present invention is a hand operated tool for extracting an elongated object that is embedded in the surface of a body, comprising:

a) an elongated, movable first handle member with a first, upper end portion being divided into two matching legs, the legs being separated by an opening;

b) a corresponding second handle member having a first, upper end extending through the opening between a first and a second one of the legs, the second handle member being pivotally attached to the first leg and the second leg, the second handle member comprising a first jaw member at its first end;

c) a floating head portion pivotally attached to the first and second legs, the floating head portion comprising a second jaw member and an adjacent, upper curved edge; and d) two matching lever bars, each being pivotally connected at one end portion of the lever bar to the second handle member and at an opposite end portion of the lever bar to the floating head portion, the lever bars facing one another from opposite sides of the tool; and wherein the second jaw member is engaged against the first jaw member when the tool is in a closed position, and disengaged from the first jaw member when the tool is in an open position. The extraction tool preferably includes a claw at an end of the curved edge opposite the jaw member for loosening or removing an embedded object.

The extraction tool of the present invention presents a unique advantage in that it can aid in quick, safe, clean removal of a wide variety of staple, nails, or tacks, regardless of the position the staple, nail, or tack is in at the time. Damage to the surface, such as splintering and gouging, is minimized because staple, nails, and tacks are more easily and smoothly removed by pulling them through. Crown moldings, baseboards, shelves, paneling, and other surfaces can thus be preserved and reused. The present device does not require a great deal of force to use, and preliminary nail straightening is virtually eliminated, so physical demands are less. Many small injuries, particularly punctures and bruises on the thumb and forefinger, are avoided. Worker job frustration is decreased because spent staples, nails, tacks, and the like can be removed without trouble.

The versatile tool of the present invention can grasp and remove short or long, slender or thick staples, nails, or tacks with smooth or rough finishes. This extraction tool is capable of pulling intact or broken-off nails or tacks with broken or small or nonexistent nail heads, so long as some portion of the shaft is visible above the surface. This extraction tool is also capable of pulling staples or nails having nail heads, in which the staple or nail head does protrude enough above the surface for traditional pliers or other types of gripping tools to grasp. The extraction tool is inexpensive to manufacture, easy to use, and effective in removing quantities of spent staples, nails, tacks, or other elongated objects.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
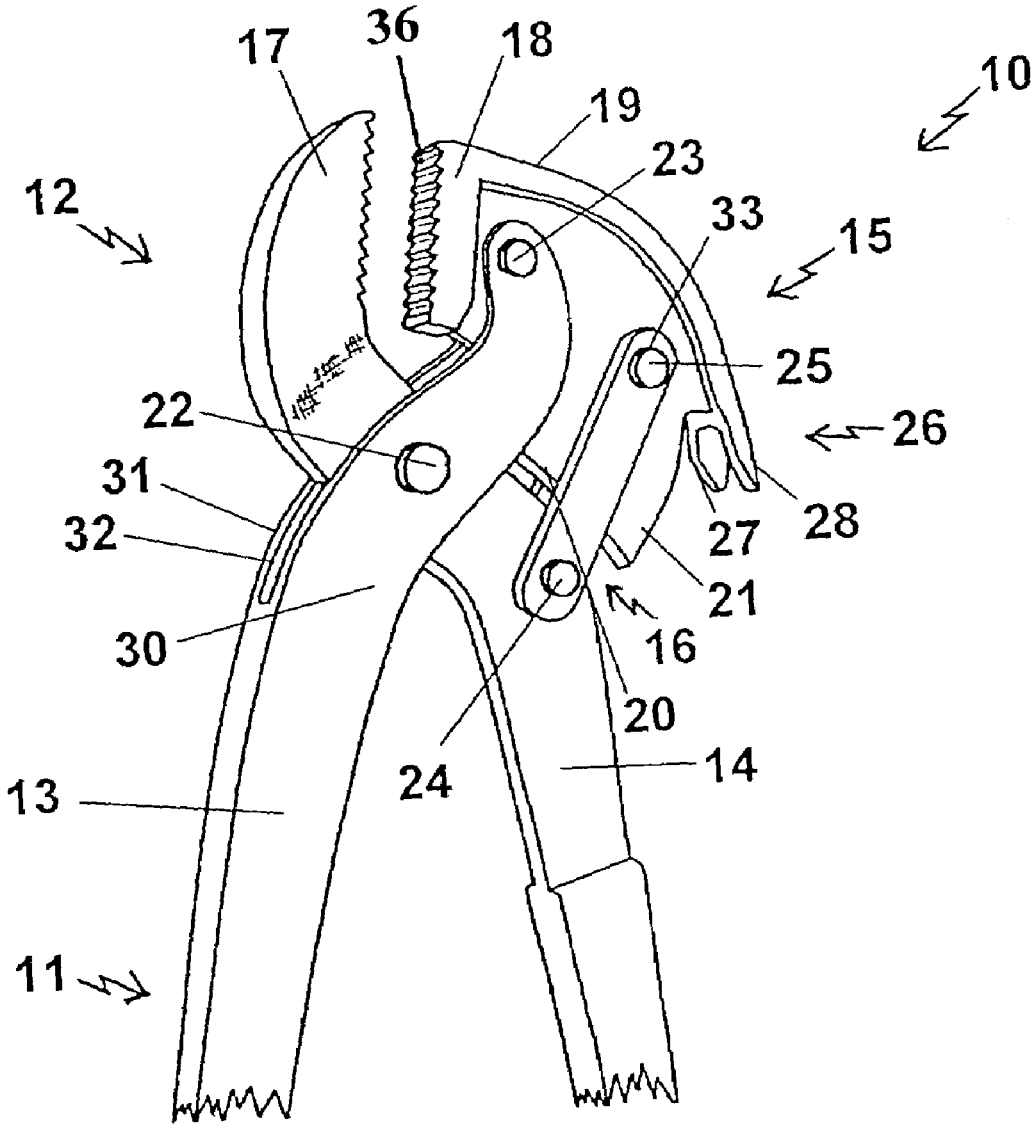
FIG. 1 is a perspective view of an upper portion of an extraction tool according to the present invention, shown in an open position.

In the following description, like reference characters designate like or corresponding parts throughout the several views. Also, in the following description, it is to be understood that such terms as "front," "back," "within," and the like are words of convenience and are not to be construed as limiting terms. Referring in more detail to the drawings, the invention will now be described.

Referring to FIGS. 1 through 6, an extraction tool constructed in accordance with the present invention is generally shown at 10. A preferred embodiment of the extraction tool 10 comprises an elongated, movable handle section 11 attached to a head section 12. The extraction tool 10 is used for extracting an elongated object, especially a nail or staple, from a surface in which it is embedded, especially a wooden board. The embedded elongated object is often in a deformed, difficult to extract position. A portion of the embedded elongated object may be broken off or bent. The extraction tool 10 is preferably substantially made of good quality tool steel, or any other suitable, sturdy material.

Figure 2:
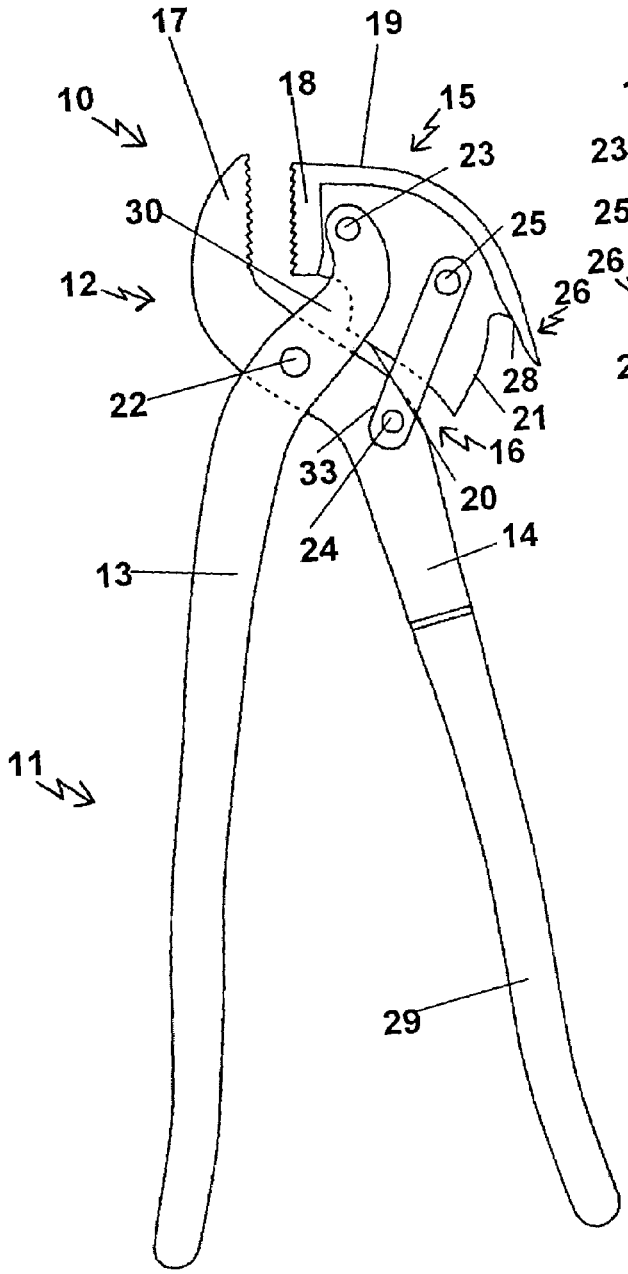
FIG. 2 is a front elevational view of an extraction tool according to FIG. 1, shown in an open position.
Figure 3:
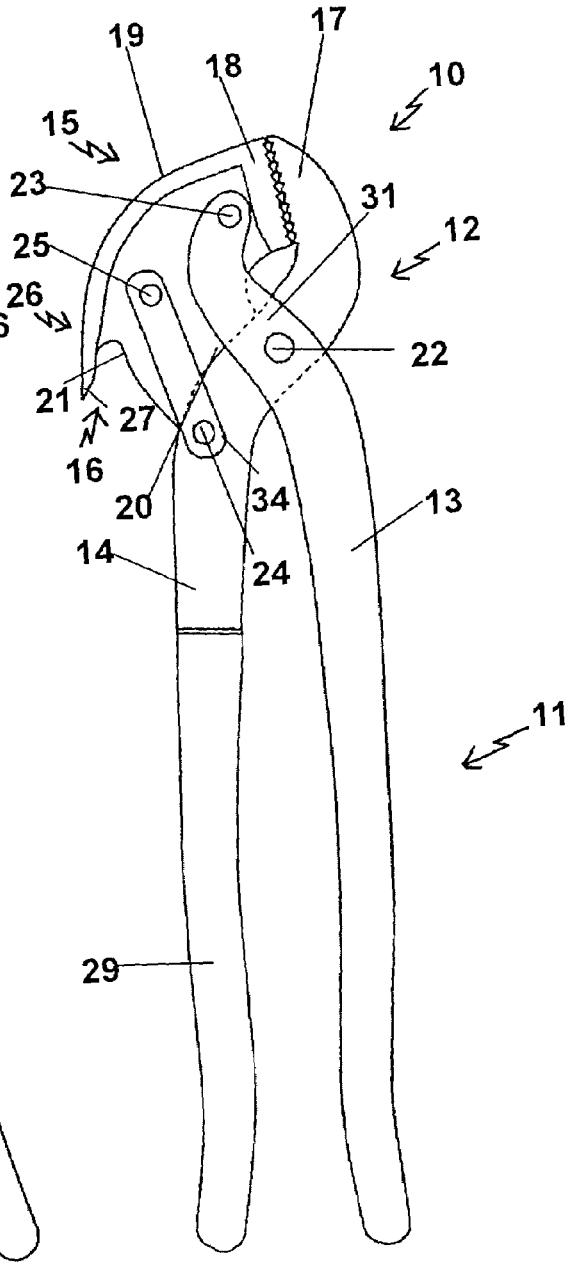
FIG. 3 is a rear elevational view of an extraction tool according to FIG. 1, shown in a closed position.

With continued attention to FIGS. 1 through 3, the extraction tool 10 generally has four parts, with four pivot points: 1) an elongated, movable first handle member 13; 2) an elongated second handle member 14 pivotally attached to the first handle member 13; 3) a floating head portion 15 pivotally attached to the first handle member 13; and 4) the two matching lever bars 33, 34, which movably connect to the second handle member 14 at one end of the lever bars and the floating head portion 15 at the opposite end of the lever bars. The extraction tool 10 generally has two positions: open, as shown in FIGS. 1 and 2; and closed, as shown in FIG. 3. The free end portions of the handle members 13, 14 may have textured rubber-like covers or grips 29 for comfort. Although the head portion 12 is at the upper end of the extraction tool when the tool is not in use, the head portion 12 is at the lower end of the extraction tool when the extraction tool is held by a user in readiness for extraction of an elongated object, As seen in FIGS. 1, 2 and 3, a first, upper end of the first handle member 13 splits into two corresponding legs, a first leg 30 and a second leg 31. The first and second legs 30, 31 are separated by an opening 32, through which a second, upper end of the second handle member 14 extends. A main pivot pin 22 extending through the end portions of the first leg 30, the second handle member 14, and the second leg 31 pivotally connects the first handle member 13 and the second handle member 14, forming a cross-like shape. As seen in FIG. 1, the floating head portion 15 also partially extends through the leg opening 32. A second pivot pin 23 extends through the end of the first leg 30, the floating head portion 15, and the end of the second leg 31, pivotally connecting the floating head portion 15 to the first handle member 13.

The extraction tool has been found herein to work optimally where the matching first and second legs of the first handle member each have a curved end portion 35, which is pivotally attached to the floating head portion. The curved end portion 35 helps in maintaining the parallel relationship of the jaw members to one another. The lower portions of the first and second handle members are preferably bowed, most preferably at the lower portion of the handle members, as shown in FIGS. 2 and 3.

Additionally, the lever bar section 16 is comprised of a front lever bar 33 and a matching rear lever bar 34. The front lever bar 33 connects one side of the second handle member 14 and the floating head portion 15, and the rear lever bar 34 connects the other side of the second handle member 14 and the floating head portion 15. Thus, the front lever bar faces the rear lever bar from opposite sides of the tool.

Thus, double-sided connections exist between the first handle member 13 and the second handle member 14, the first handle member 13 and the floating head portion 15, and the second handle member 14 and the floating head portion 15. The double-sided connections between these components (e.g., matching handle legs 30, 31 and lever bars 33, 34) of the extraction tool 10 impart greater stability and strength to the construction of the extraction tool 10 than a one-sided connection, such as one side of the first handle member 13 being connected to one side of the second handle member 14. The first leg 30 and the second leg 31 of the first handle member 13 and the front lever bar 33 and the rear lever bar 34 also make the extraction tool 10 visually appealing because each both sides of the extraction tool 10 are identical and balanced. During manufacture, less care needs to be taken in riveting the pivot points of the double sided tool versus a single-sided tool design (with a first handle member connected to one side of the second handle member).

The removal tool of the present invention is for pulling out an elongated object, particularly a staple, nail, or tack embedded in the surface of a body. A visible portion of the elongated object, such as the bottom part of a nail shaft (body) or central part of a staple, must extend at least slightly beyond the surface in order for the user to see it and the extraction tool 10 to grasp it. The extraction tool 10 has an open position (see FIGS. 1, 2, 4 and 5) for placing the jaw members 17, 18 on opposite sides of the embedded elongated object, and a closed position (see FIGS. 3 and 6) for grasping and pulling the elongated object. The second jaw member 18 is engageable against the first jaw member 17. The jaw members 17, 18 maintain a parallel relationship to one another in both the open and closed positions.

In use, the extraction tool 10 is placed in an open position as shown in FIGS. 1 and 2 by pulling the upper, free ends of the handle members 13, 14 away from each other. The handle members 13, 14 are preferably approximately perpendicular to the surface when the extraction tool 10 is covering the protruding portion of the nail, staple, tack, or other object. By "covering the nail" is meant that the two jaw members are in place on either side of the nail shaft, staple, or other elongated object. The extraction tool 10 is placed over the projecting portion of the elongated object, with the first jaw member 17 on one side of the projecting portion of the object and the second jaw member 18 on the other side. Once the extraction tool 10 is contacting the surface, frequently a wooden board, the upper, free end portions of the handle members 13, 14 are squeezed towards one another, which closes the jaw members over the object. Importantly, this can be accomplished with one hand.

The preferred embodiment illustrated in FIGS. 1 through 3 is versatile in that it also comprises a claw 26 connected to the upper, curved edge 19 of the floating head portion 15 at an end opposite the second jaw member 18. The claw 26 can be used on embedded objects, particularly headed nails and tacks such as upholstery tacks, sheetrock/drywall tacks, and roofing nails. For example, the claw 26 may be used where the central part of an embedded staple does not extend far enough beyond the surface for the first jaw member 17 and the second jaw member 18 to grasp the staple, or where the head of an embedded nail does not extend far enough beyond the surface for the first jaw member 17 and the second jaw member 18 to grasp it. The claw 26 preferably comprises a first prong 27 and a matching second prong 28, which are longitudinally oriented. Each claw prong 27, 28 gradually narrows to a flattened point at the end of each claw prong 27, 28 (see FIG. 1).

Importantly, the claw 26 is connected to, preferably continuous with, the curved edge 19 of the rounded floating head portion, so the extraction tool 10 can be rocked back and forth on the floating head portion 15, if desired, without interference by the claw 26. The claw 26 points in a downward direction, as shown in FIG. 1, and away from the jaw members 17, 18, so it does not interfere with extraction of the embedded object by the jaws. With this extraction tool 10, the carpenter or other user can quickly switch between the claw and the jaw members, depending on the particular problem before him or her. One tool 10 suffices where two were required before, and the one tool 10 allows a better job to be done more quickly.

To use the claw 26 of the preferred embodiment shown in FIGS. 1 through 3, the first handle member 13 and the second handle member 14 are held in the hand and squeezed towards one another until the extraction tool 10 is in a closed position, as depicted in FIG. 3. Still grasping the first handle member 13 and the second handle member 14 together in the palm of one hand, the user places the claw of the extraction tool 10 against the surface containing the staple, nail, etc. to be removed, and inserts the points of the first prong 27 and the second prong 28 as far as possible underneath the central part of the staple, or on either side of the head of the nail. Next, the user simply rocks the floating head portion 15 against the surface, beginning at the claw 26 and rocking along the curved edge 19 towards the second jaw member 18, until the central part of the staple or the head of the nail rises far enough off the surface for removal by the jaw members 17, 18. The rocking motion may be repeated until the central part of the staple or the head of the nail is sufficiently separated from the surface. The claw 26 may also be used to completely remove a staple, or a nail having a nail head, from a surface, without aid from the first jaw member 17 and the second jaw member 18, regardless of whether the staple or nail protrudes far enough from the surface for the jaw members 17, 18 to grip it. Again, the double-sided component of the extraction tool 10 adds to the tool's stability and strength, so that it may withstand the force exerted on it when the claw 26 is in use.

Figure 4:
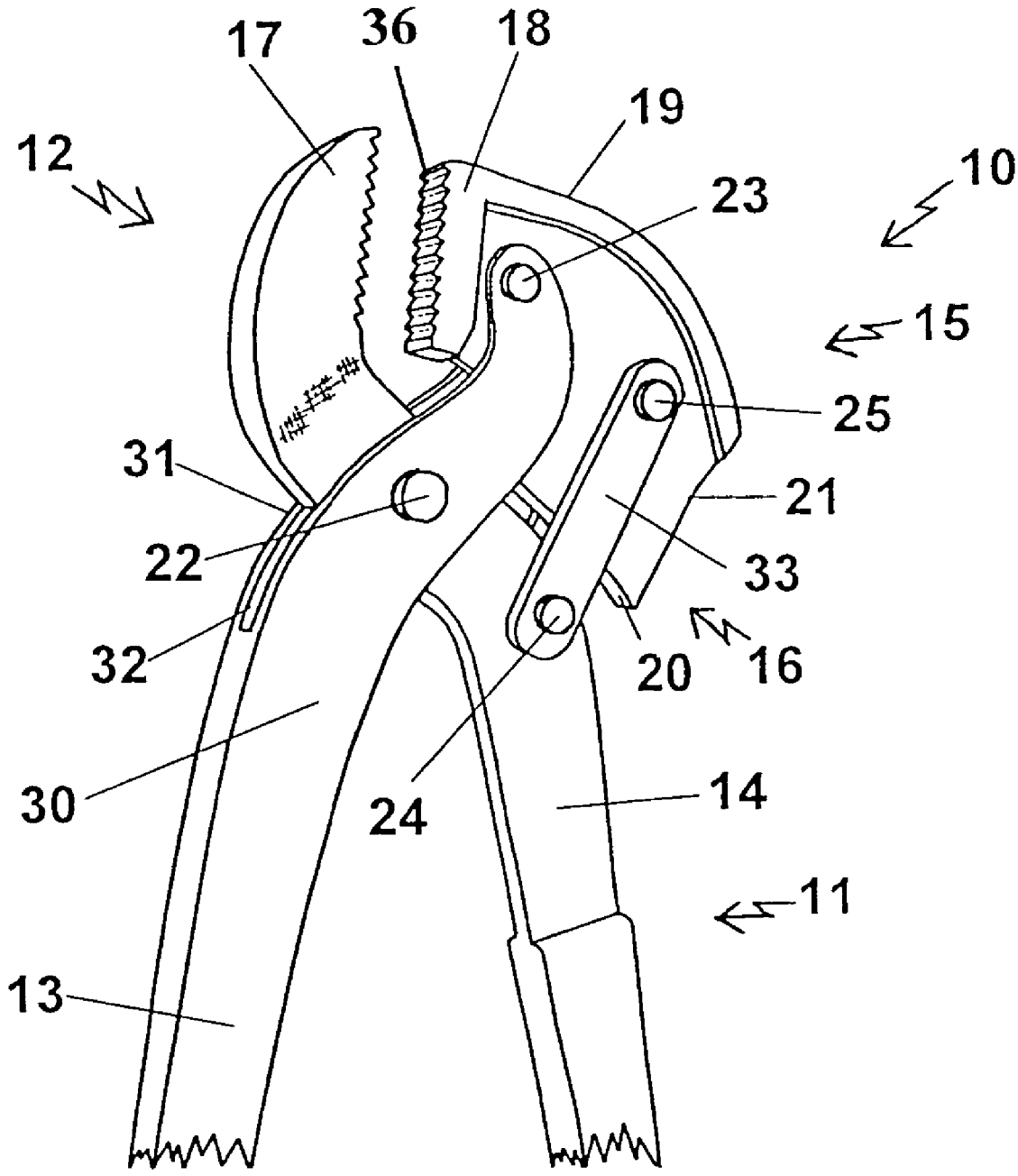
FIG. 4 is a perspective view of an upper portion of an alternate embodiment of an extraction tool according to the present invention, shown in an open position.
Figure 5:
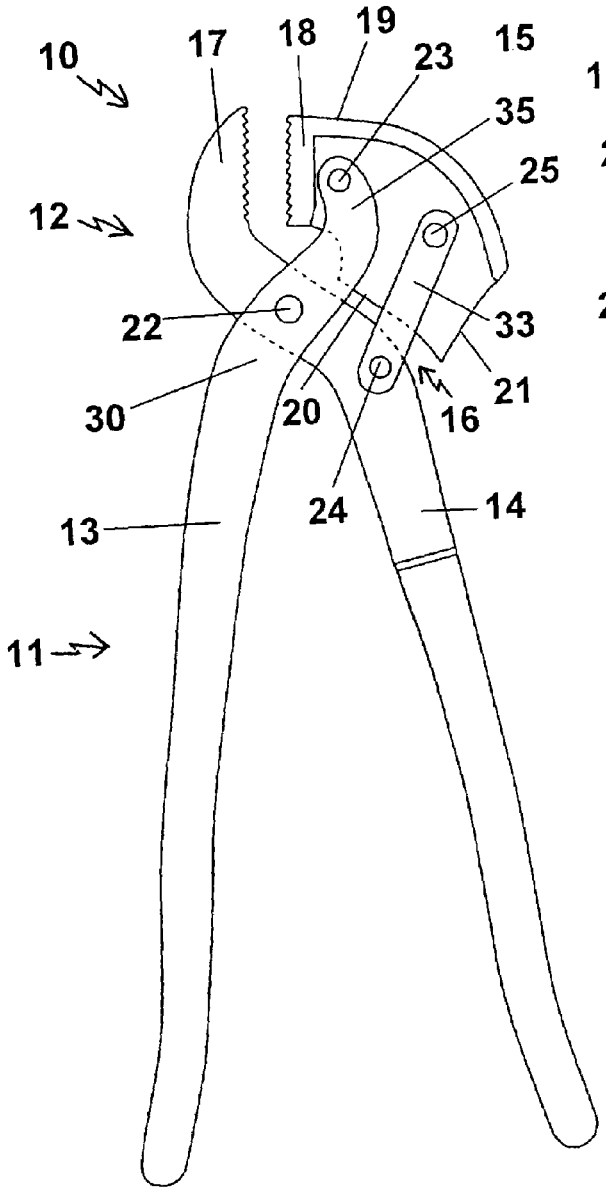
FIG. 5 is a front elevational view of an extraction tool according to FIG. 4, shown in an open position.
Figure 6:
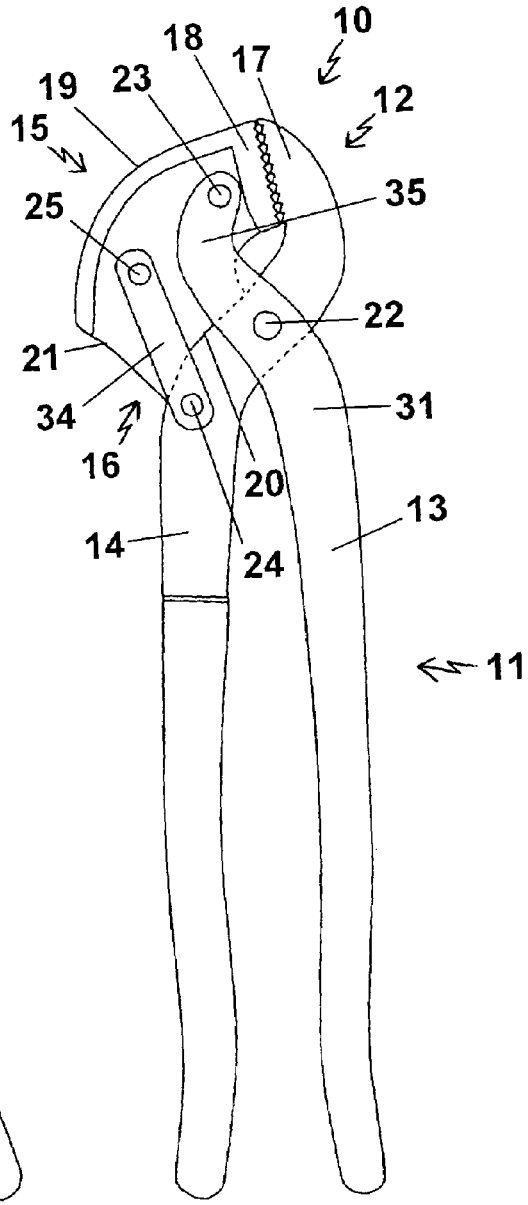
FIG. 6 is a rear elevational view of an extraction tool according to FIG. 4, shown in a closed position.

An alternate embodiment of the extraction tool 10, shown in FIGS. 4 through 6, does not comprise the claw 26, but is otherwise the same as the preferred embodiment.

As shown in the embodiments in FIGS. 1 through 6, the second handle member 14 comprises a serrated first jaw member 17 along one end portion, and the floating head portion 15 comprises a corresponding serrated second jaw member 18 along one of its sides. The extraction tool's jaw members 17, 18 are parallel to one another. Preferably, one or both, most preferably both, jaws are serrated. The serrated teeth 36 allow a good grip on the shaft of the embedded object. As shown in FIGS. 1 through 6, the serrated gripping teeth 36 are most preferably oriented in an upward direction (i.e., leaning toward the main pivot pin), and oppose one another, in order to enhance the grasp on the object being extracted. As seen in FIGS. 3 and 6, the uppermost, or first set of, teeth in each jaw member preferably oppose each other, so that the extraction tool 10 contacts the embedded object as close to the surface (substrate) as possible. Other gripping means could be employed in place of serrated teeth.

In both of the embodiments of FIGS. 1 through 3, and FIGS. 4 through 6, the upper edge 19 of the floating head portion 15 is curved, so that the extraction tool 10 can rock back on the curved edge 19 during extraction of the embedded object with either the jaw members 17, 18, or the claw 26 (in FIGS. 1 through 3). By "floating" head portion is meant that this portion of the tool is movable and is not connected to the rest of the tool except by pivot pins. The curved edge 19 on the floating head portion creates a lifting force, with minimum resistance to the user. The upper curved edge 19 of the floating head portion is preferably flattened, as is the upper edge of the claw 26, so that the flat edge is in contact with the surface when the closed extraction tool 10 rocks back.

The width of the curved edge 19 can vary, although it is preferably between about ¾ and 1¼ centimeters, most preferably approximately ⅜ inch, in width. This width is important in that it helps to prevent damage to the surface (ordinarily wood) during extraction of the nail. A thin layer of rubber or other cushioning material, or a protective coating, can be applied along the curved edge 19 to further cushion the curved edge. The remainder of the floating head portion may be at a slightly lower level than the curved edge 19 and the jaw member 18, as shown in FIGS. 2, 3, 5, and 6. As a result, the ends of the second pivot pin 23 and a third pivot pin 25, which project through the floating head portion 15, are not as likely to scratch the user. This allows the extraction tool 10 to have a flatter front and rear appearance, and facilitates shipping of these extraction tools.

Referring to FIGS. 1-3 and 4-6, the third, lower side 20 of the floating head portion 15 is preferably slightly curved so that it fits against the curve in the second handle member 14 when the extraction tool is in a closed position. However, the floating head portion 15 can have various shapes and need not fit against the second handle member 14. The majority of the fourth side 21 of the floating head portion 15, which is roughly perpendicular to the lower side 20 of the floating head portion is preferably relatively flat, as shown in FIG. 1, so that it does not physically interfere with the functioning of the claw 26.

As shown in FIGS. 1 through 6, each extraction tool 10 comprises four pivot points in two sets. In the first set, the pivot pins are inserted along an upper, end portion of the first handle member 13 comprising the first leg 30 and the second leg 31. The main pivot pin 22 pivotally connects the first handle member 13 to the second handle member 14 at the base of the head section 12. The main pivot pin 22 extends through holes in the first leg 30, the second handle member 14, and the second leg 31. The second pivot pin 23 pivotally connects the end of the first handle member 13 and a forward section of the floating head portion 15 next to the second jaw member 18. The second pivot pin 23 extends through holes in the first leg 30, the forward section of the floating head portion 15, and the second leg 31. At the main pivot pin 22, the curved first handle member 13 crosses perpendicularly over the curved second handle member 14, generally forming an X-shape.

The second set of pivot pins is inserted at opposite ends of the lever bars. A third pivot pin 24 pivotally connects the lower ends of the front and rear lever bars 33, 34 to the second handle member 14, and a fourth pivot pin 25 pivotally connects the upper ends of the front and rear lever bars 33, 34 to a rear section of the floating head portion 15. Specifically, the third pivot pin 24 extends through the front lever bar 33, the second handle member 14, and the rear lever bar 34, and the fourth pivot pin 25 extends through the front lever bar 33, the rear section of the floating head portion 15, and the rear lever bar 34. A rivet or screw can be used in place of a pivot pin at a similar pivot point. The lever bars 33, 34 maintain the parallel relationship between the jaw members 17, 18.

In sum, then: 1) the main pivot pin 22 passes through corresponding holes in the first handle member 13 and the second handle member 14; 2) the second pivot pin 23 passes through corresponding holes in the end of the first handle member 13 and a forward section of the floating head portion 15; 3) the third pivot pin 24 connects the second handle member 14 to the lower ends of the front and rear lever bars 33, 34; and 4) the fourth pivot pin 25 passes through corresponding holes in the upper ends of the lever bars 33, 34, and a rear section of the floating head portion 15. The distance between the main pivot pin 22 and the second pivot pin 23, and between the third pivot pin 24 and the fourth pivot pin 25, are substantially equal to one another. The distance between the main pivot pin 22 and the third pivot pin 24, and between the second and fourth pivot pins 23, 25, are substantially equal to one another. A parallelogram is thus formed. The parallelogram shape shifts as the extraction tool 10 is brought from an open position to a closed position and back again. Preferably, the main pivot pin 22, and the second, third, and fourth pivot pins 23-25 are rivets.

The extraction tool 10 employs a compound lever action. The lever bars 33, 34 pivot further out on the floating head portion 15 and are anchored to the second handle member 14, which has the opposite jaw member 17. Without meaning to be bound by theory, it is believed that two important things happen because of this compound lever action: a) the jaw members 17, 18 stay in a parallel relationship, which maintains as many teeth as possible in contact with the embedded object for a slip-free grip; and b) the curved edge 19 is attached to the opposing jaw member by the front and rear lever bars 33, 34. Once the rolling or lifting of the nail, staple, or other elongated object begins, the resistance force is believed to be passed to the jaw member opposite to the curved edge, which causes a self-actuating grip. Net: once the extraction is initiated, the handle members no longer need to be squeezed. At that point, only a prying action is required to complete the extraction.

This extraction tool 10 is for removing damaged or intact staples, nails, or tacks inserted with a pneumatic gun, or the like, by gripping the exposed part of the nail or staple once the board or the like is removed from the wall. The extraction tool of the present invention can grasp and remove slender or thick staples, nails, or tacks with smooth or rough finishes. It can be used on nails manufactured without heads, and nails with heads that are broken or sheared off. This extraction tool 10 is capable of pulling long or short, intact or broken-off staples, nails, or tacks, regardless of whether they were driven into the surface by a hammer or by pneumatic means. This extraction tool 10 has been found to work particularly well on wiring staples, fencing staples, roofing tacks, and upholstery tacks. The present extraction tool can also be used for other common tasks, like holding a bolt, or straightening a metal wire.

This extraction tool 10 is preferred for use on finishing nails of any length or width, bent or straight, especially pneumatic finishing nails. Relatively new pneumatic finishing nails are particularly difficult to remove from surfaces because they have a very smooth finish and are so slender that they cannot easily be backed out without bending them. Efforts to pull them out of wooden surfaces using conventional tools often results in splintering of the surface or in the nails snapping off. The nail removal tool of the present invention grabs these pneumatic finishing nails and ordinarily pulls them cleanly through and out of the surface.

The staples, or other elongated objects to be removed may be embedded in wooden baseboards, moldings, shelving, paneling, hardwood floors, etc. The extraction tool of the present invention is particularly useful for remodeling projects. Workmen who will be pulling apart wooden elements of a residence or business and then replacing them may also find this extraction tool helpful. For example, exterminators and burglar alarm installers often must pull up baseboards, etc. to do their work. They can use this tool for removing nails prior to reattaching the baseboards and other surfaces. This tool is useful wherever the removal and spent staples, etc. from wooden or wood-like surfaces is particularly important. It is particularly useful for remodeling projects in historic homes, where preservation of existing crown moldings, baseboards, etc. is of paramount importance.

In a preferred embodiment herein: a) the extraction tool 10 is between about ten and 12 inches in length and about two and three inches wide; b) the jaw members 17, 18 are between about ½ inch and 1½ inches in length, and about ¼ and ½ inch in width; c) the curved edge 19 is between about two and three inches in length and about the same width as the jaw members 17, 18; d) the same-sized lever bars 33, 34 are between about one and two inches in length; and e) the floating head portion 15 is between about one and three inches in length and width. The length of the handle section 11 is preferably between about three and six times the width of the head section 12. The long handle members 13, 14 are useful for gaining leverage during the extraction process.

This invention is a versatile, inexpensive, hand operated tool for removing staples, nails, tacks, or other elongated objects from surfaces, such as moldings, baseboards, and shelves, in which they have been driven or inserted (embedded). This extraction is accomplished without undue damage to the surface, due to the curved edge 19 and the leverage afforded by the long handle members 13, 14. The handle section 11 is preferably three to six times the width of the head section 12. With the present device, the worker's initial attempts at removal of staples, nails, and tacks are successful a high percentage of the time. It is believed that this is more true of the present tool than of other currently available devices.

The extraction tool 10 with the claw 26 preferably comprises:

a) an elongated, movable first handle member 13 comprising a first, upper end portion being divided into two matching legs 30, 31, the legs 30, 31 being separated by an opening 32;

b) a corresponding second handle member 14 comprising a first, upper end extending through the opening between a first and a second one of the legs 30, 31, the second handle member 14 being pivotally attached to the first leg 30 and the second leg 31, the second handle member 14 comprising a first jaw member 17 at its first end;

c) a floating head portion 15 pivotally attached to the first and second legs 30, 31, the floating head portion 15 comprising a second jaw member 18 and an adjacent, upper curved edge 19;

d) two matching lever bars 33, 34, each being pivotally connected at one end portion of the lever bar to the second handle member 14 and at an opposite end portion of the lever bar to the floating head portion 15, the lever bars 33, 34 facing one another from opposite sides of the tool 10; and e) a claw 26 connected to the upper, curved edge 19 of the floating head portion 15 at an end opposite the second jaw member 18; and wherein the second jaw member 18 is engaged against the first jaw member 17 when the tool 10 is in a closed position, and disengaged from the first jaw member 17 when the tool 10 is in an open position. The claw 26 preferably comprises two matching prongs 27, 28, each having a flattened, pointed end. The first and second jaw members 18 each preferably comprise serrated teeth 36, and maintain a parallel relationship to one another in both the open and closed positions. Preferably, the main pivot pin 22 passes through corresponding holes in the legs of the first handle member 13 and the second handle member 14; and the second pivot pin 23 passes through corresponding holes in the ends of the legs 30, 31 of the first handle member 13 and a forward section of the floating head portion 15.

The elongated object is extracted through a body made of wood or a wood substitute by the following steps:

a) engaging a portion of the elongated object with a first prong 27 and a second prong 28 of a claw of a hand tool 10;

b) rocking the hand tool 10 back on a curved, flattened edge 19 of the hand tool in a direction away from the wooden surface, so as to partly disengage the elongated object from the surface;

c) disengaging the elongated object from the hand tool 10;

d) engaging a portion of the elongated object by a hand tool 10, the hand tool 10 comprising two opposing jaw members 17, 18 and a floating head portion 15, the floating head portion 15 comprising a second one of the jaw members 18, and a curved, flattened edge extending perpendicularly from the second jaw member 18;

e) operating the hand tool 10 such that the hand tool 10 grips the elongated object and exerts twisting and pulling forces on the elongated object in a direction at an acute angle to the body surface;

f) rocking the hand tool 10 back on the curved, flattened edge 19 in a direction away from the wooden surface, so as to fully disengage the elongated object from the surface; and g) disengaging the elongated object from the hand tool 10.

Figure 7:
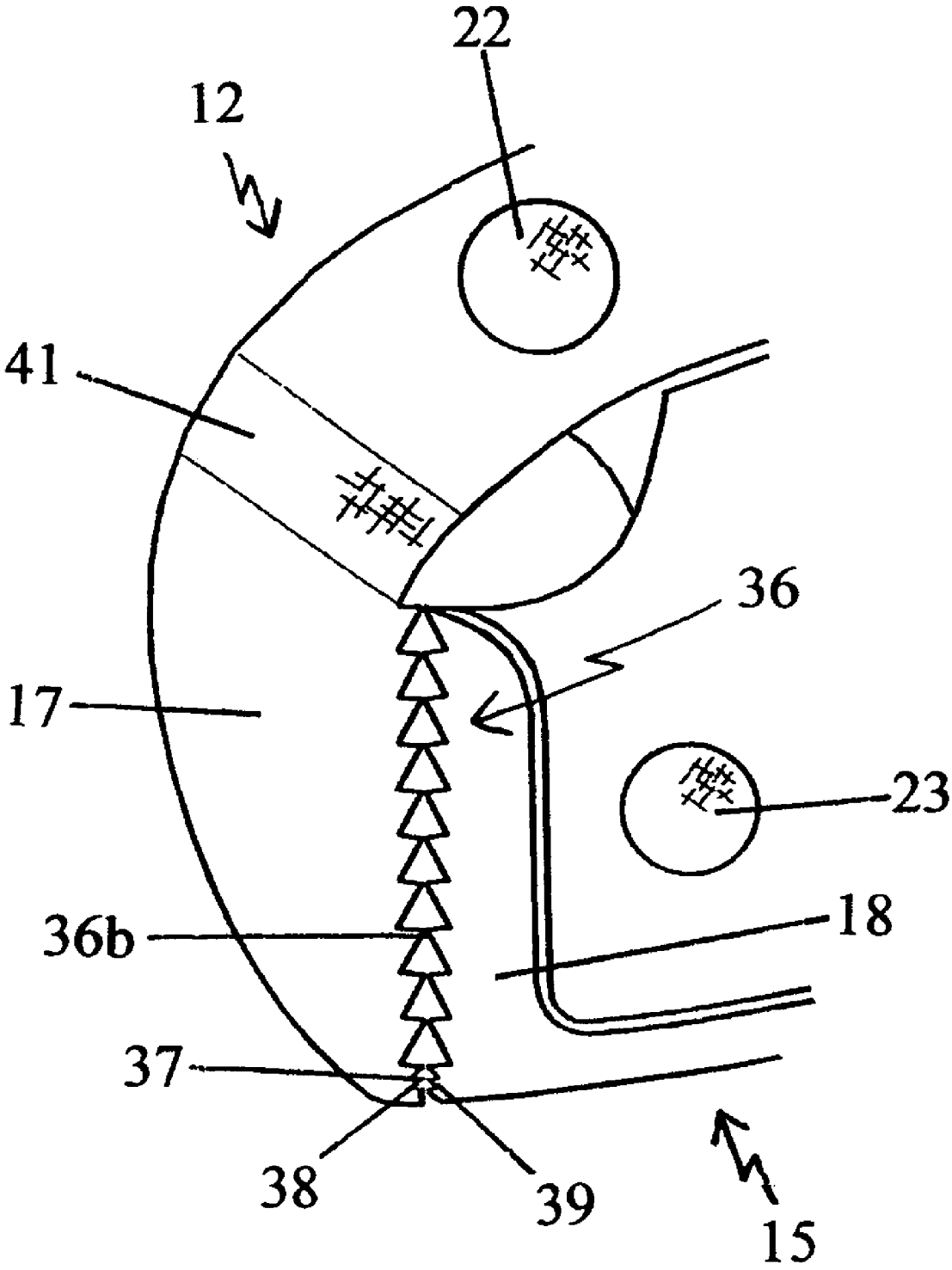
FIG. 7 is a rear elevational view of the jaw members of an extraction tool according to the present invention, shown in a closed position.
Figure 8:
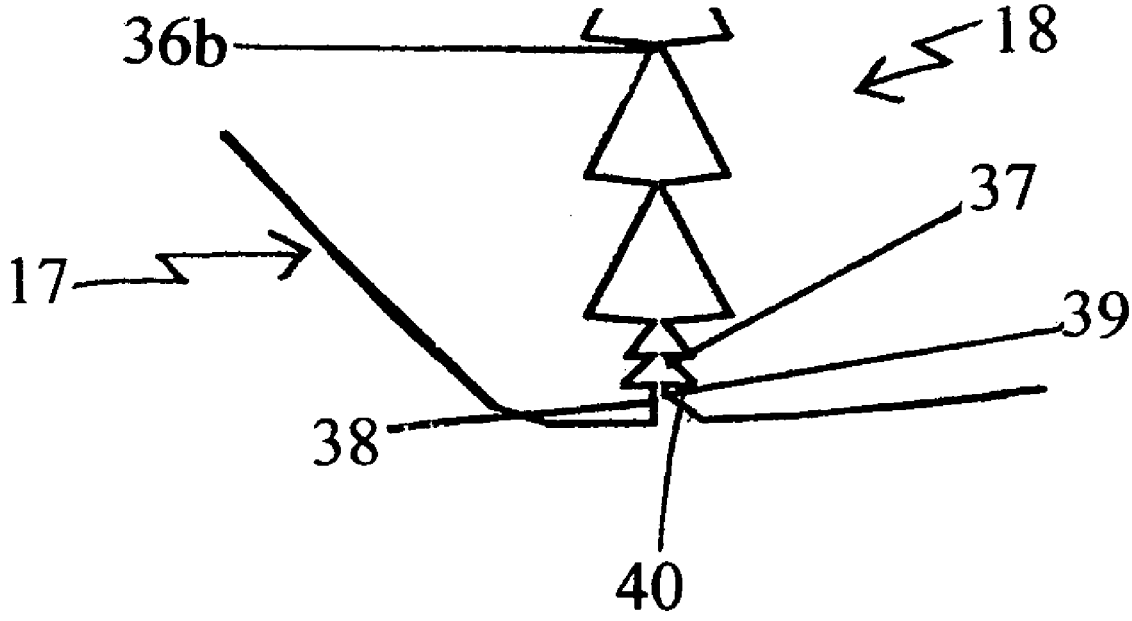
FIG. 8 is a close-up of the rear elevational view of FIG. 7.

Referring to FIGS. 7 and 8, a preferred embodiment of the present invention includes substantially parallel first and second jaw members 17, 18 as described herein, with a specific pattern of teeth 36 in front. This set of front teeth has been discovered to improve overall performance of the tool 10, particularly in situations where the head of the nail or other embedded object is close to the surface (not much exposure), making it difficult to grasp and remove. The teeth 36 are aligned generally perpendicular to the longitudinal axis of the handle members, as seen in FIG. 1.

As shown in FIGS. 7 and 8, the second and third front gripping teeth 37 (counting from the front of the jaw) are smaller than the larger number of rear gripping teeth 36*b* on the jaw members. The numerous rear teeth 36*b* on the first and second jaw members 17, 18 are preferably all about the same size as one another. The second and third teeth 37 are also preferably about the same size as one another, but they are about half the size of the larger teeth 36*b* to the rear of the jaw. For example, if the rear teeth are each about 0.5 centimeters in height, the second and third teeth 37 are each about 0.25 centimeters in height. The height of and distance between the rear teeth 36*b* are preferably the same as one another. In this preferred embodiment, the teeth 36*b*, 37 are pointed at the top and serrated inwardly, except for the first teeth 38, 39. In other words, the pointed gripping teeth are preferably oriented in an upward direction and they incline toward the main pivot pin. The angle a between the sides of any two adjacent rear teeth 36*b* is preferably between about 60 and about 70 degrees. This angle has been found herein to allow an optimal grip on the nail or other embedded object.

The tool teeth 36*b*, 37, 38, 39 oppose one another. The corresponding top and bottom teeth on the two jaws 17, 18 therefore both contact the nail head or other object being extracted and thus enhance the grasp on the object. The pointed tips of the rear teeth 36*b* contact each another when the jaws are in the closed position, as seen in FIG. 7. However, the second and third teeth 37 preferably do not contact one another, though they are preferably only from about 0.3 to about 1 millimeter apart when the jaws are in the closed position, as seen in FIG. 8. This has been found herein to be advantageous in that the front teeth 37, 38, 39 are less likely to break off. These front teeth 37, 38, 39 facilitate removal of even sheet rock screws, rusty old nails, and small pin nails, for example.

The top and bottom front teeth 38, 39 at the front of the first and second jaw members are not identical, though. Unlike the rear teeth 36*b* and the second and third teeth 37, the top and bottom front teeth 38, 39 have a flattened contact surface, though the two flattened surfaces do not meet when the tool is in the closed position, as shown in FIG. 8. Advantages include a lower likelihood that the planar teeth will break off after extended use. The bottom front tooth 39 on the second, floating jaw member 18 has a chamfer 40, or missing corner, which forms approximately a 45 degree angle with the planar surface of the tooth 39. The planar surface of the top front tooth 38 therefore has a larger surface area than the planar surface of the bottom front tooth 39.

The tool 10 preferably includes a stepped (tapered) area 41 on the first jaw member 17, as seen in FIGS. 7 and 1. The tool material is thicker in the front jaw area than it is at the rear of the jaw member (e.g., under the pivot pin 22). The thicker area provides an increased grasping area and makes the tool stronger where strength is needed for optimal operation. Since steel and other suitable materials can be expensive, this represents a cost savings.

The curved edge 19, or crown, is also thicker than, for example, the adjacent area on the floating jaw. This provides a stable "rocker" for the tool. In contrast with conventional tools, the tool of the present invention seeks the closed position even when the object is engaged. Once the embedded object has been grasped by the jaw members 17, 18, the "automatic locking feature" is engaged, and the user need not exert any more force squeezing the handle members 13, 14 together. Instead, the user can rock the tool 10 back on the thick, durable curved edge 19, which exerts force on the object without taxing the user. The same is true in reverse when the first and second prongs 23, 24 of the claw 26 are placed on either side of a nail head or another object. Since, unlike the claw of a conventional hammer, the claw prongs 23, 24 are substantially parallel to the second handle member 14, the prongs extend the curve of the curved edge 19. Once the object is in place between the claw prongs 23, 24 the user rocks the head portion forward on the curved edge 19. This exerts force on the nail, thus facilitating its removal from the surface in which it is embedded, without straining the user.

In summary, the tool 10 includes gripping teeth 36 that comprise a number of same-sized, serrated rear teeth 36*b*, and second and third front teeth 37 with a height that is about half the height of the rear teeth. The second and third teeth 37 are preferably substantially the same size as one another. The serrated rear teeth 36*b* on the opposite jaw members 17, 18 oppose one another, and the second and third teeth 37 on the first jaw member 17 oppose the corresponding teeth 37 on the opposite, second jaw member 18. When the tool 10 is in a closed position, the opposing rear teeth 36*b* contact one another, but the second and third teeth 37 do not contact the corresponding teeth 37 on the opposite jaw member when the tool 10 is in a closed position. The first teeth 38, 39 comprise the planar upper surface, and the bottom first tooth 39 comprises the outer chamfer 40.

Figure 9:
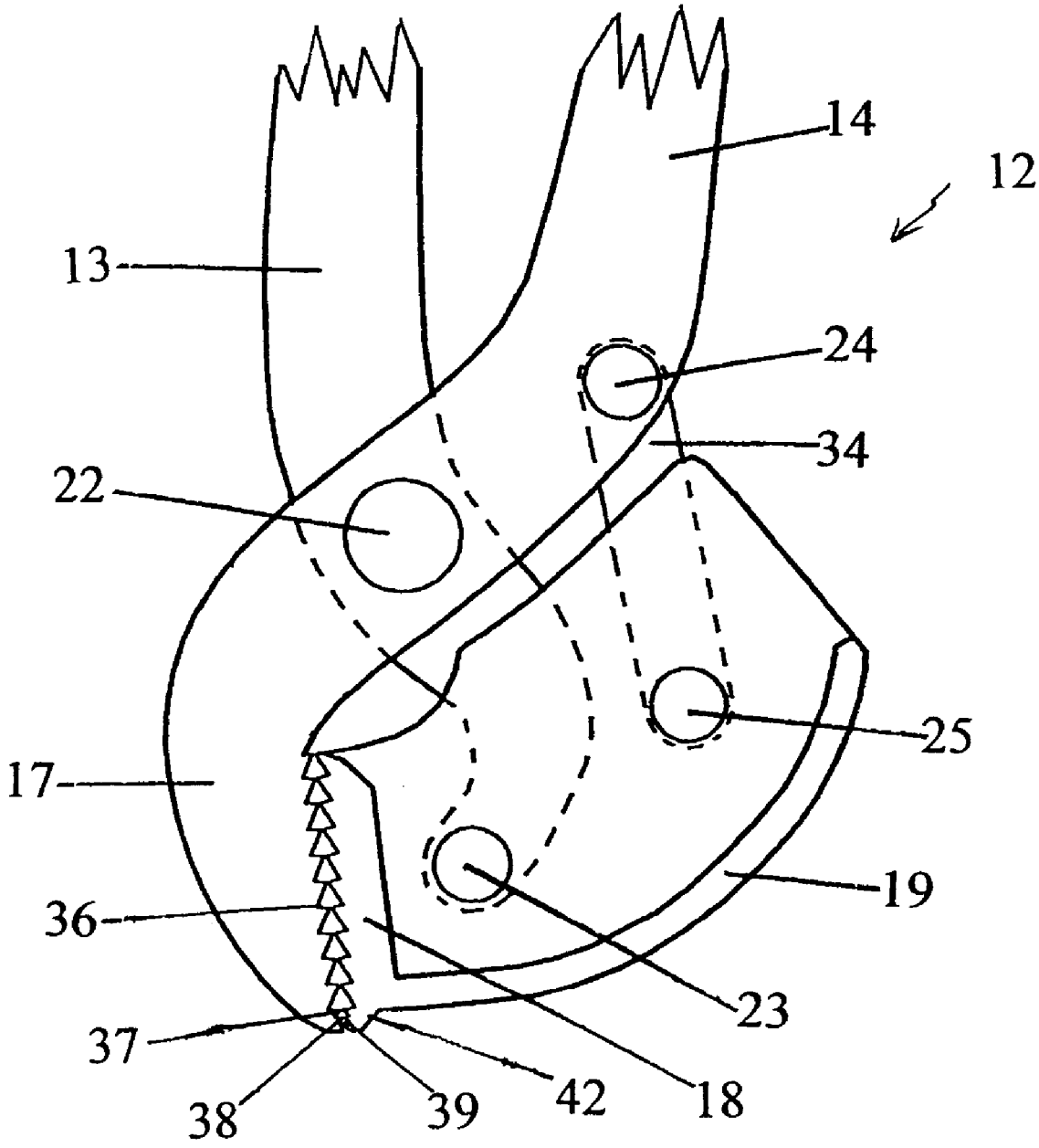
FIG. 9 is a rear elevational view of a head portion of an extraction tool according to the present invention, shown in a closed position.

Turning to FIG. 9, the tool of the present invention may include a front lip 42, or indentation, at the base of the bottom front tooth 39 on the outside tip of the second jaw member 18. Even though the lip is small and does not affect the line and performance of the curved edge 10 of the floating head portion, the lip 42 is quite useful where the tool 10 is being used to remove embedded objects, such as staples, in a soft surface, such as a carpet or foam padding. The head section 12 with its beak-like front lip 42 is compressed into the soft surface to grasp the difficult to remove staple or other embedded object.

From the foregoing it can be realized that the described tool of the present invention may be easily and conveniently utilized for extracting elongated objects from surfaces in which they are embedded. It is to be understood that any dimensions given herein are illustrative, and are not meant to be limiting. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention. It is intended that the doctrine of equivalents be relied upon to determine the fair scope of these claims in connection with any other person's product which fall outside the literal wording of these claims, but which in reality do not materially depart from this invention.

BRIEF LIST OF REFERENCE NUMBERS USED IN THE DRAWINGS extraction tool
handle section
head section
first handle member
second handle member
floating head portion
lever bar section
first jaw member
second jaw member
curved edge of floating head portion
lower side of floating head portion
fourth side of floating head portion
main pivot pin
second pivot pin
third pivot pin
fourth pivot pin
claw
first prong
second prong
handle grip
first leg
second leg
leg opening
front lever bar
rear lever bar
curved end portion of leg
serrated teeth
$2^{nd}$ & $3^{rd}$ teeth
top front tooth
bottom front tooth
chamfer
stepped area
front lip

What is claimed is:

1. A hand operated tool for extracting an elongated object that is embedded in the surface of a body, the tool comprising:

a) an elongated, movable first handle member comprising a first, upper end portion divided into two matching legs, the legs being separated by an opening;

b) a corresponding second handle member comprising a first, upper end extending through the opening between a first and a second one of the legs, the second handle member being pivotally attached to the first leg and the second leg, the second handle member comprising a first jaw member at its first end;

c) a floating head portion pivotally attached to the first and second legs, the floating head portion comprising a second jaw member and an adjacent, upper curved edge; and d) two matching lever bars, each being pivotally connected at one end portion of the lever bar to the second handle member and at an opposite end portion of the lever bar to the floating head portion, the lever bars facing one another from opposite sides of the tool; and wherein the second jaw member is engaged against the first jaw member when the tool is in a closed position, and disengaged from the first jaw member when the tool is in an open position; wherein the first and second jaw members each comprise a plurality of serrated gripping teeth, the gripping teeth comprising a plurality of same-sized, serrated rear teeth, and second and third front teeth, the height of the second and third front teeth being less than the height of the rear teeth; and wherein the opposing rear teeth contact one another when the tool is in a closed position, but the second and third teeth do not contact corresponding second and third teeth on the opposite jaw member when the tool is in a closed position; and wherein the curved edge of the floating head portion is flattened and oriented perpendicular to the second jaw member.

2. The tool according to claim 1, further comprising a claw connected to the upper, curved edge of the floating head portion at an end opposite the second jaw member, the claw comprising two matching prongs, each prong extending substantially parallel to the second handle member.

3. The tool according to claim 1 wherein the serrated rear teeth on the opposite jaw members oppose one another, and the second and third teeth on the first jaw member oppose the corresponding teeth on the opposite, second jaw member, the second and third teeth being substantially the same size as one another.

4. The tool according to claim 3, wherein the gripping teeth further comprise a first tooth at a front of each jaw member, the first tooth at the front of the second jaw member comprising an outer chamfer.

5. The tool according to claim 4, wherein the first and second legs of the first handle member each have a curved end portion, the curved end portion being pivotally attached to the floating head portion.

6. The tool according to claim 1, further comprising a front lip at a base of a first, front one of the gripping teeth on the second jaw member.

7. A hand operated tool for extracting an elongated object that is embedded in the surface of a body, the tool comprising: a) an elongated, movable first handle member comprising a first, upper end portion divided into two matching legs, the legs being separated by an opening; b) a corresponding second handle member comprising a first, upper end extending through the opening between a first and a second one of the legs, the second handle member being pivotally attached to the first leg and the second leg, the second handle member comprising a first jaw member at its first end; c) a floating head portion pivotally attached to the first and second legs, the floating head portion comprising a second jaw member and an adjacent, upper curved edge; and d) two matching lever bars, each being pivotally connected at one end portion of the lever bar to the second handle member and at an opposite end portion of the lever bar to the floating head portion, the lever bars facing one another from opposite sides of the tool; and wherein the second jaw member is engaged against the first jaw member when the tool is in a closed position, and disengaged from the first jaw member when the tool is in an open position; wherein the first and second jaw members each comprise a plurality of serrated gripping teeth, the gripping teeth comprising a plurality of same-sized, serrated rear teeth, and second and third front teeth, the height of the second and third front teeth being less than the height of the rear teeth; and wherein the opposing rear teeth contact one another when the tool is in a closed position, but the second and third teeth do not contact corresponding second and third teeth on the opposite jaw member when the tool is in a closed position; the tool further comprising a claw connected to the upper, curved edge of the floating head portion at an end opposite the second jaw member, the claw comprising two matching prongs, each prong extending substantially parallel to the second handle member; and wherein the curved edge of the floating head portion is flattened and oriented perpendicular to the second jaw member.

8. The tool according to claim 7, further comprising a main pivot pin which passes through corresponding holes in the legs of the first handle member and the second handle member.

9. The tool according to claim 8, further comprising a second pivot pin which passes through corresponding holes in the ends of the legs of the first handle member and a forward section of the floating head portion.

10. The tool according to claim 9, further comprising a third pivot pin which connects through corresponding holes in the second handle member and a lower end of each of the lever bars.

11. The tool according to claim 10, further comprising a fourth pivot pin which passes through corresponding holes in an upper end of each of the lever bars and a rear section of the floating head portion.

12. The tool according to claim 11, wherein the distance between the main pivot pin and the second pivot pin, and between the third pivot pin and the fourth pivot pin, are substantially equal to one another.

13. The tool according to claim 11, wherein the distance between the main pivot pin and the third pivot pin, and between the second and fourth pivot pins, are substantially equal to one another, thus forming a parallelogram.

14. The tool according to claim 13, wherein the jaw members maintain a parallel relationship to one another in both the open and closed positions of the tool.

15. The tool according to claim 13, wherein the length of the handle section is between about three and six times the width of the head section.

16. The tool according to claim 13, wherein the matching first and second legs of the first handle member each have a curved end portion, which is pivotally attached to the floating head portion; and the first and second handle members are bowed.

17. A hand operated tool for extracting an elongated object that is embedded in the surface of a body, the tool comprising:

a) an elongated, movable first handle member comprising a first, upper end portion divided into two matching legs, the legs being separated by an opening;

b) a corresponding second handle member comprising a first, upper end extending through the opening between a first and a second one of the legs, the second handle member being pivotally attached to the first leg and the second leg, the second handle member comprising a first jaw member at its first end;

c) a floating head portion pivotally attached to the first and second legs, the floating head portion comprising a second jaw member and an adjacent, upper curved edge;

d) two matching lever bars, each being pivotally connected at one end portion of the lever bar to the second handle member and at an opposite end portion of the lever bar to the floating head portion, the lever bars facing one another from opposite sides of the tool; and e) a claw continuous with the upper, curved edge of the floating head portion at an end opposite the second jaw member; and wherein the second jaw member is engaged against the first jaw member when the tool is in a closed position, and disengaged from the first jaw member when the tool is in an open position, and the jaw members maintain a parallel relationship to one another in both the open and closed positions of the tool; wherein the first and second jaw members each comprise a plurality of serrated gripping teeth, the gripping teeth comprising a plurality of same-sized, serrated rear teeth, and second and third front teeth with a height that is less than the height of the rear teeth; and wherein the opposing rear teeth contact one another when the tool is in a closed position, but the second and third teeth do not contact corresponding second and third teeth on the opposite jaw member when the tool is in a closed position; and wherein the curved edge of the floating head portion is flattened and oriented perpendicular to the second jaw member.

18. The tool according to claim 17, wherein the height of the second and third front teeth is about half the height of the rear teeth, the second and third teeth being substantially the same size as one another.

19. The tool according to claim 18, wherein the serrated rear teeth on the opposite jaw members oppose one another, and the second and third teeth on the first jaw member oppose the corresponding teeth on the opposite, second jaw member.

20. The tool according to claim 18, wherein the gripping teeth comprise a first tooth on a front of each jaw member, the first tooth on the front of each jaw member comprising a planar upper surface, the first tooth on the front of the second jaw member further comprising an outer chamfer.

* * * * *